US006454520B1

(12) United States Patent
Pickelman et al.

(10) Patent No.: US 6,454,520 B1
(45) Date of Patent: Sep. 24, 2002

(54) ENHANCED V-BLADE IMPELLER DESIGN FOR A REGENERATIVE TURBINE

(75) Inventors: Dale M. Pickelman, Saginaw; John Gardner Fischer, Goodrich, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/571,825

(22) Filed: May 16, 2000

(51) Int. Cl.[7] ..... F04D 5/00
(52) U.S. Cl. ..... 415/55.1
(58) Field of Search ..... 415/55.1, 55.2, 415/55.3, 55.4; 416/237

(56) References Cited

U.S. PATENT DOCUMENTS 5,299,908 A * 4/1994 Robbie ..... 415/55.1
5,372,475 A * 12/1994 Kato et al. ..... 415/55.1
5,527,149 A * 6/1996 Moss et al. ..... 415/55.1
5,762,469 A * 6/1998 Yu ..... 415/55.1

* cited by examiner

*Primary Examiner*—Edward K. Look
*Assistant Examiner*—Richard A. Edgar
(74) *Attorney, Agent, or Firm*—Vincent A. Cichosz

(57) ABSTRACT

A novel impeller for a regenerative turbine fuel includes a hub and a plurality of V-shaped vanes that project radially outward. The hub defines an aperture into which the shaft of the pump is securable. Each V-shaped vane includes a pair of fin members. Each fin member has an inner sidewall and an outer sidewall. The fin members of each vane are adjoined by their inner sidewalls. From their adjoined inner sidewalls, the fin members of each vane diverge to their respective outer sidewalls. In particular, the fin members of each vane diverge at a prespecified angle relative to a plane that lies normal to the center axis and also bisects the hub. Along at least part of its length, the trailing corner of each outer sidewall of each V-shaped vane is chamfered. The chamfer is made at a predetermined angle relative to the aforementioned plane.

30 Claims, 5 Drawing Sheets

FIG. 11
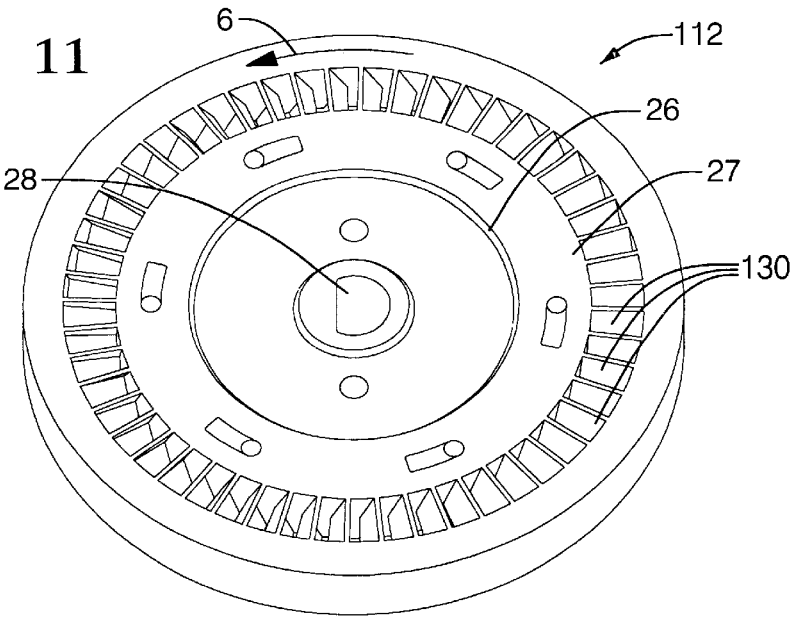
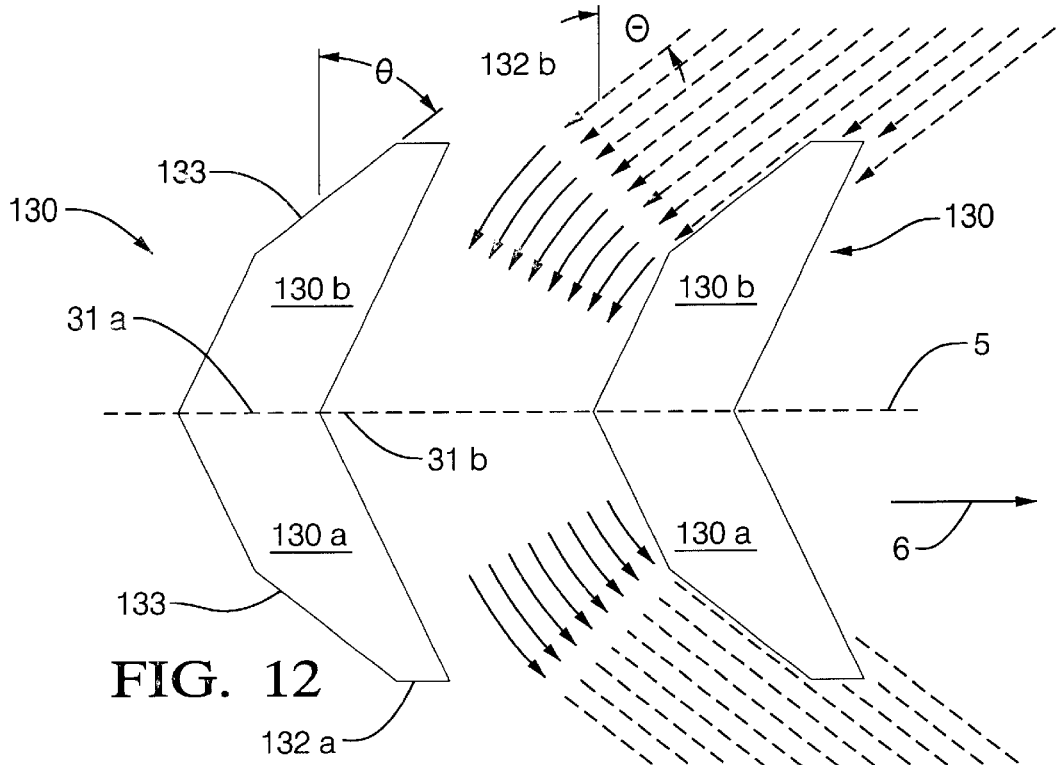
FIG. 12
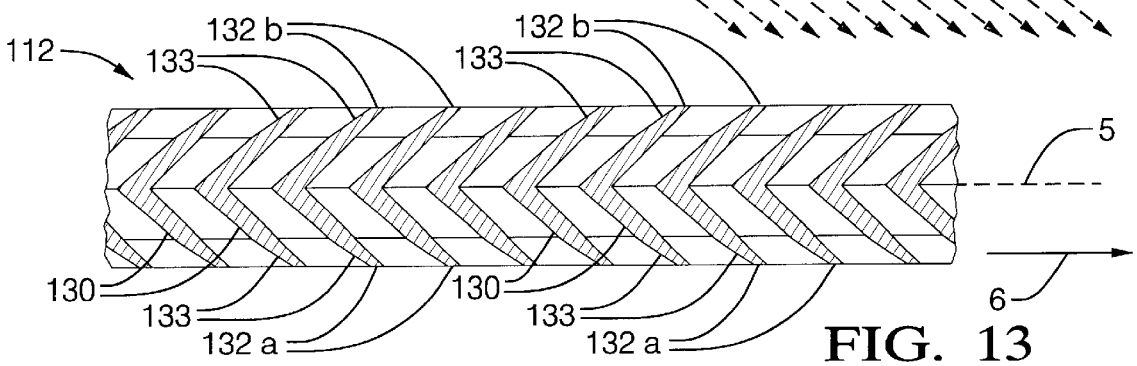
FIG. 13

ENHANCED V-BLADE IMPELLER DESIGN FOR A REGENERATIVE TURBINE

FIELD OF THE INVENTION

The invention relates generally to regenerative turbine pumps of the type that are used to pump fuel from a fuel tank to an engine of a motor vehicle. More particularly, the invention pertains to an improved V-blade impeller, for a regenerative turbine pump, whose design not only improves the overall mechanical efficiency of the high pressure section of the pump but also retains the ability to be manufactured by conventional low-cost injection molding techniques.

BACKGROUND OF THE INVENTION

The following background information is provided to assist the reader to understand the environment in which the invention will typically be used. Upon reading this document, the reader will appreciate that the invention may also be applied or adapted to environments other than that described below.

As used in the fuel system of a motor vehicle, a regenerative turbine pump is intended to provide the engine of the vehicle with fuel at relatively high pressure at moderate flow rates. U.S. Pat. Nos. 5,580,213, 5,509,778, 5,393,206, 5,393,203, 5,280,213, 5,273,394, 5,209,630, 5,129,796, 5,013,222 and 4,734,008 are generally representative of the variety of regenerative turbine fuel pumps used in the automotive industry. The teachings of these earlier patents are therefore incorporated into this document by reference.

FIGS. 1–6 illustrate one type of regenerative turbine fuel pump, generally designated 10, along with its associated structure and internal components. This regenerative turbine pump 10 is housed within a tubular metal shell 14, also referred to in the literature as a pump housing. Encased within this metal shell 14 is an electric motor 18. The motor 18 is built around an armature shaft 20, as is well known in the art, and is positioned within the housing 14 so that the shaft 20 can be rotated about a longitudinal center axis 4. Projecting from one end of the housing 14 is a terminal 11. It is through this terminal 11 via a wiring harness (not shown) on the vehicle that electrical energy can be supplied to the electric motor 18.

As best shown in FIGS. 1 and 2, an impeller 12 is mounted to one end of the shaft 20. The impeller 12 is situated between a pair of generally cylindrical plates 22*a* and 22*b*. Between the plates 22*a* and 22*b* there is defined a generally disk-shaped space 24 within which the impeller 12 is designed to rotate. This space 24 is best shown in FIG. 4. An annular groove 23*a* in the inside face of outer plate 22*a* cooperates with an annular groove 23*b* in the outside face of inner plate 22*b* to form an annular pump channel 23. As best shown in FIGS. 3 and 4, the outer plate 22*a* also defines an inlet port 34 that communicates with annular groove 23*a*. Similarly, the inner plate 22*b* defines an outlet port 36 that communicates with annular groove 23*b*.

The fuel tank of the vehicle communicates with the annular pump channel 23 through the inlet port 34 in outer plate 22*a*. This communication occurs through the annular groove 23*a* on the inlet side of impeller 12, as well as through known passageway(s) internal to fuel pump 10. The pump housing 14 has a discharge tube 48 to which the outlet port 36 is connected via other known passageway(s) within the fuel pump 10. Through outlet port 36, discharge port 48 communicates with the annular pump channel 23 on the outlet side of impeller 12, i.e., through annular groove 23*b*.

It is from this discharge tube 48 that pressurized fuel is discharged from and delivered by the fuel pump 10 for use by the engine of the vehicle.

The impeller 12 serves as the rotary pumping element for the regenerative turbine pump 10. As shown in FIGS. 1–5, the impeller 12 basically takes the form of a disk having a hub 26 whose axis of rotation is centered on center axis 4. The hub 26 defines an aperture 28 at its center. The aperture 28 is notched, to accommodate the like-shaped shaft 20 of motor 18. The notched aperture 28 allows the shaft 20 to drive the impeller 12 when the electrical motor 18 is activated.

The impeller 12 has a plurality of fan blades 30 that project radially outward from the hub 26. Also referred to as vanes, the fan blades 30 are generally spaced from each other uniformly. As best shown in FIGS. 4–6, each of the vanes 30 is V-shaped. Radiating from the periphery of hub 26, the vanes are situated in between and adjacent to the annular grooves 23*a* and 23*b* in outer and inner plates 22*a* and 22*b*, respectively. In other words, the vanes 30 are positioned directly within the annular pump channel 23 of the regenerative turbine pump 10.

FIGS. 5 and 6 illustrate the structure of the vanes 30. Each V-shaped blade 30 has a pair of fin members 30*a* and 30*b*, each having a generally rectangular cross-section. The base of each fin member emanates from the hub 26. Each fin member 30*a* and 30*b* lies at angle of approximately 45° with respect to a plane of intersection 5 that bisects impeller 12 longitudinally. This plane appears as a line in FIG. 6, as two fan blades 30 of impeller 12 are viewed therein from the top. The inner sidewalls 31*a* and 31*b* of fin members 30*a* and 30*b* are formed together along the plane 5 during the injection molding process that is used to manufacture the impeller 12. From their adjoined inner sidewalls, the fin members of each vane 30 diverge away from each other. These adjoined fin members 30*a* and 30*b* together form upstream and downstream faces. Facing the direction of rotation 6, the upstream face of each vane 30 is generally concave, exhibiting an angle of approximately 90°. The downstream face is convex, exhibiting a similar angle on the back side of vane 30. Each vane 30 also has two generally flat outer sidewalls 32*a* and 32*b*. Fin member 30*a* has outer sidewall 32*a* and fin member 30*b* has outer sidewall 32*b*.

FIG. 5 best illustrates how the vane(s) 30 are oriented with respect to, and are moved within, the annular pump channel 23. FIG. 5 shows the annular groove 23*a* in the inside face of outer plate 22*a*. The annular groove 23*b* in the outside face of inner plate 22*b* is best shown in FIG. 2. Outer sidewall 32*a* lies directly adjacent to annular groove 23*a*, and outer sidewall 32*b* lies adjacent to annular groove 23*b*. The vanes 30 of impeller 12 thus lie within the annular pump channel 23 that is defined by annular grooves 23*a* and 23*b*. The annular pump channel 23 essentially encompasses the vanes 30 of impeller 12.

The regenerative turbine fuel pump 10 operates as follows. When electricity is supplied via terminal 11 to the electric motor 18, the armature shaft 20 immediately begins to rotate. The rotation of shaft 20, in turn, causes the impeller 12 to rotate within the disk-shaped space 24 between the inner and outer plates 22*a* and 22*b*. Fuel from the fuel tank is sucked into the inlet port 34 and flows into the annular groove 23*a*, and thus into the annular pump channel 23. As the impeller 12 rotates, its V-shaped vanes 30, in combination with annular grooves 23*a* and 23*b* on either side, cause the fuel to whirl about the annular pump channel 23 in a toroidal flow path, as is best shown in FIG. 5. In particular, as impeller 12 rotates, the fuel exits each vane 30 at the tip and then re-enters the base of the trailing vane 30. As is known in the art, this regenerative cycle of exiting the tip of the leading blade 30 and entering the base of the trailing blade 30 occurs many times as the fuel is conveyed through the annular pump channel 23 by the vanes 30 moving on the periphery of impeller 12.

As the impeller rotates, the movement of the V-shaped vanes 30 through the annular pump channel 23 imparts momentum to the fuel as it flows along the toroidal flow path. On the outlet side of impeller 12 (i.e., through annular groove 23*b*), the fast moving fuel then flows through the outlet port 36 defined in inner plate 22*b*. From the outlet port 36, the fuel continues flowing through the internal passageway(s) of the housing 14 and exits the fuel pump 10 through discharge port 48. In this known manner, fuel at relatively high pressure is provided to the engine of the motor vehicle at an appropriate rate of flow.

The efficiency of a regenerative turbine fuel pump (10) is limited by the loss of energy from the flow of fuel caused by the non-streamlined design of the vanes (30). The efficiency is also limited in that the injection molding process used to make such an impeller (12) requires relatively thick vane profiles.

There are at least two disadvantages inherent to the type of regenerative turbine fuel pump 10 described above. The shortcomings of interest in this document can be traced to the design of the impeller 12. With its V-shaped vanes 30, the impeller 12 is, of course, the rotary pumping element that is responsible for increasing the momentum of the fuel with each regenerative cycle. Nevertheless, the impeller 12 has at least two design flaws that result in lowering the momentum of the fuel as it enters each of the fan blades 30.

The first design flaw involves the downstream face of each vane 30. Specifically, some energy in the stream of fuel is lost behind each blade 30 due to the separation of the fluid stream and the low pressure area resulting therefrom. The area where this energy loss occurs is depicted at $L_1$ in FIG. 6, generally just behind the trailing corner 33 of each fin member.

The second design flaw involves the upstream face of the vanes 30. In particular, the flow of fuel loses more energy at the point at which the fuel impacts the leading corners of each fan blade 30. The area where this energy loss occurs is depicted at $L_2$ in FIG. 6. The combined losses due to separation and low pressure behind each blade 30 and impact of the fuel on the forward facing corners of each blade 30 serve not only to decrease the rate at which the fuel flows but also the pressure at which the fuel is provided to the engine.

OBJECTIVES OF THE INVENTION

It is, therefore, an objective of the invention to provide a new and improved impeller for a regenerative turbine pump that improves the overall mechanical efficiency of the high pressure section of the fuel pump and yet still retains a geometry that allows it to be manufactured by conventional injection molding techniques at a relatively low cost.

Another objective is to provide a new and improved impeller for a regenerative turbine pump that minimizes energy losses associated with the circulatory flow of the fuel impacting against the forward faces of the vanes as well as energy losses caused by the separation of the fuel stream behind the vanes.

A related objective is to provide an impeller whose vanes are designed to reduce the amount of energy lost from the fuel stream by minimizing the separation of the fuel stream behind each vane and the development of a low pressure area thereat.

Another related objective is to provide an impeller whose vanes are designed to reduce the amount of energy lost from the fuel stream by lessening the force with which the circulating fuel stream impacts the forward facing corners of each vane.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the accompanying drawings and claims.

SUMMARY OF THE INVENTION

The foregoing objectives and advantages are attained by a novel impeller for a regenerative turbine fuel pump. The fuel pump for which the impeller is designed should have an electrical motor and a shaft rotatable thereby about a center axis in a forward direction. In its preferred and alternative embodiments, the novel impeller comprises a hub and a plurality of innovative V-shaped vanes. The hub defines an aperture into which the shaft of the fuel pump is securable to allow the hub to rotate with the shaft about the center axis. The plurality of V-shaped vanes project radially outward from a cylindrical outer surface of the hub. Each V-shaped vane comprises a pair of fin members. Each fin member has an inner sidewall and an outer sidewall. The fin members of each vane are adjoined by their inner sidewalls. From their adjoined inner sidewalls, the fin members of each vane diverge to their respective outer sidewalls. More specifically, the fin members of each vane diverge at a prespecified angle relative to a plane that lies normal to the center axis and also bisects the hub. The fin members of each vane thus present an upstream face and a downstream face. The novelty resides principally in the trailing corners of each outer sidewall. Each outer sidewall of each vane is chamfered along at least part of the length of its trailing corner. The chamfer is made at a predetermined angle relative to the aforementioned plane.

BRIEF DESCRIPTION OF THE DRAWINGS

FIG. 11 is a top isometric view of the impeller shown in FIG. 7.

FIG. 12 is an enlarged top view of two adjacent vanes of the impeller shown in FIG. 7, showing the chamfer on the trailing corners of each V-shaped vane and how the fuel flows around the chamfered fin members of the leading vane.

FIG. 13 is a cross-sectional view of the impeller shown in FIG. 7, showing a series of vanes each of which exhibiting a chamfered corner on the rearward face of each fin member.

DETAILED DESCRIPTION OF THE INVENTION

Figure 1:
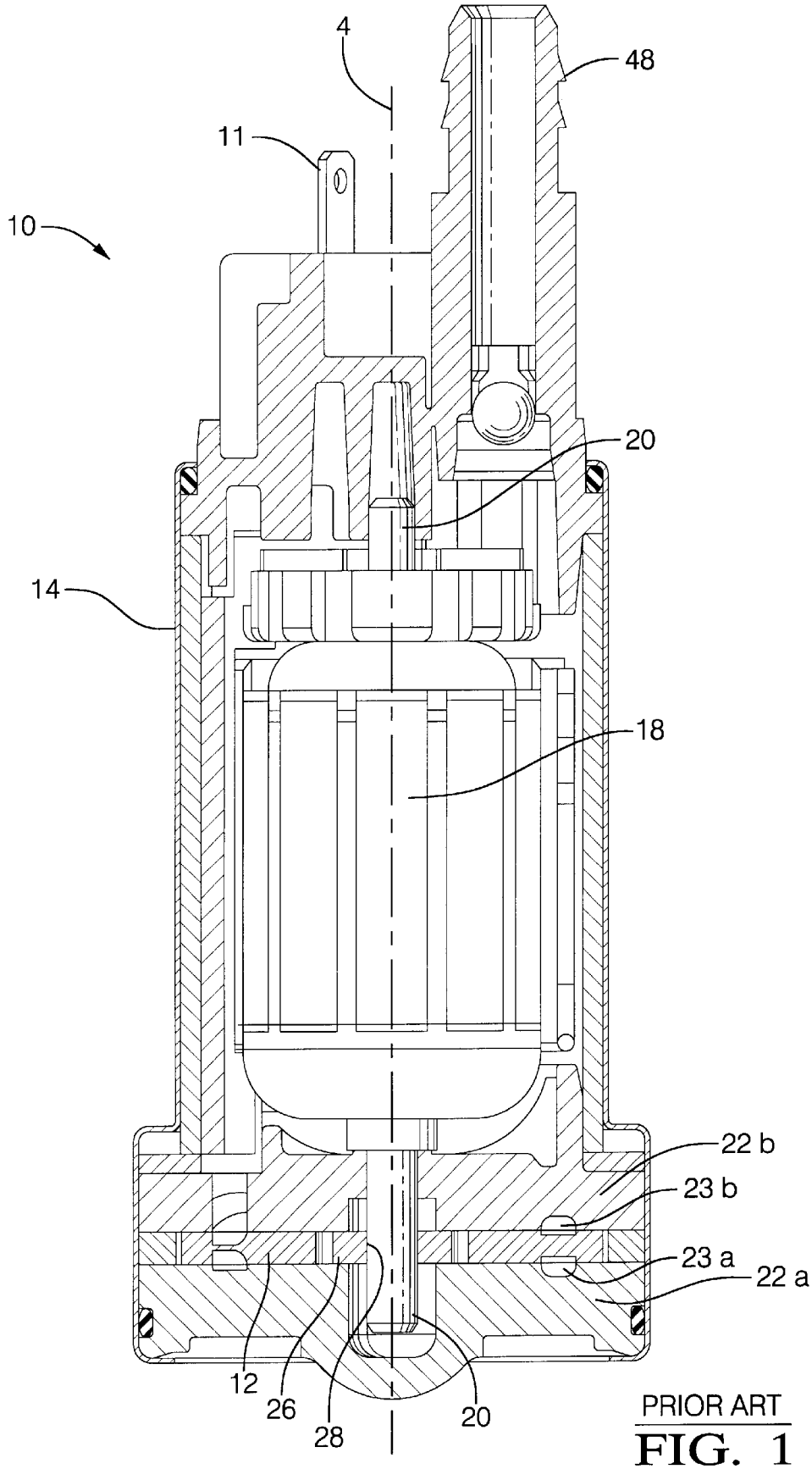
PRIOR ART FIG. 1
FIG. 1 is a cross-sectional side view of a conventional regenerative turbine fuel pump, showing an impeller attached to the end of a shaft of an electric motor.

Before describing the invention in detail, the reader is advised that, for the sake of clarity and understanding, identical components having identical functions have been marked where possible with the same reference numerals in each of the Figures provided in this document.

Figure 2:
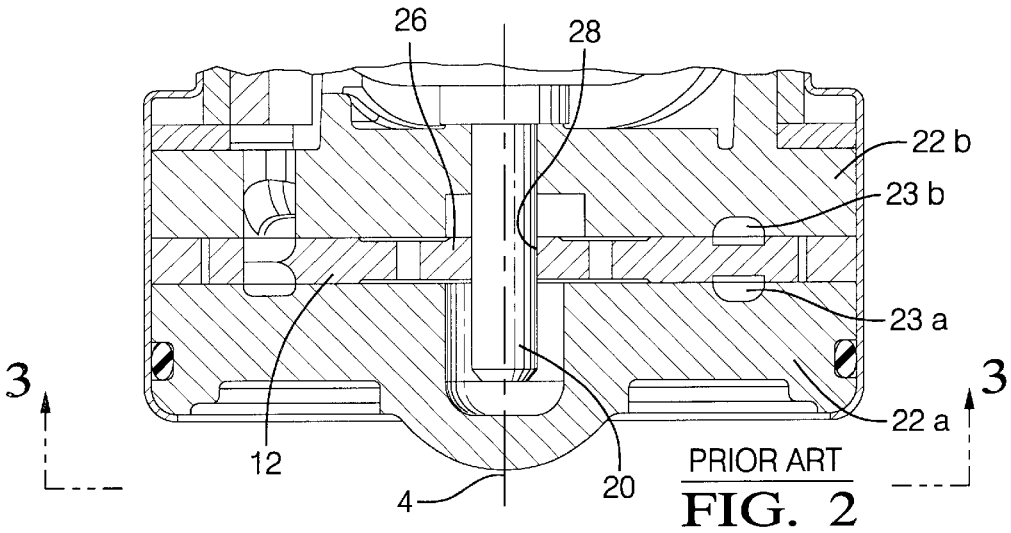
PRIOR ART FIG. 2
FIG. 2 is an enlarged view of the lower end of the regenerative turbine fuel pump shown in FIG. 1, showing more clearly the impeller attached to the end of the shaft.

FIGS. 7–13 illustrate the essential details of the invention, namely, a novel impeller 112 for a regenerative turbine fuel pump 10. The regenerative turbine pump 10 for which the impeller 112 is designed will generally include an electric motor 18, a shaft 20, a generally cylindrical outer plate 22*a* and a generally cylindrical inner plate 22*b*. FIGS. 1 and 2 show that the shaft 20 is rotatable by the motor 18 about a center axis 4 in a forward direction 6. They also show that the outer plate 22*a* has an inside face that defines a first annular groove 23*a*. Similarly, the inner plate 22*b* has an outside face that defines a second annular groove 23*b*.

Figure 3:
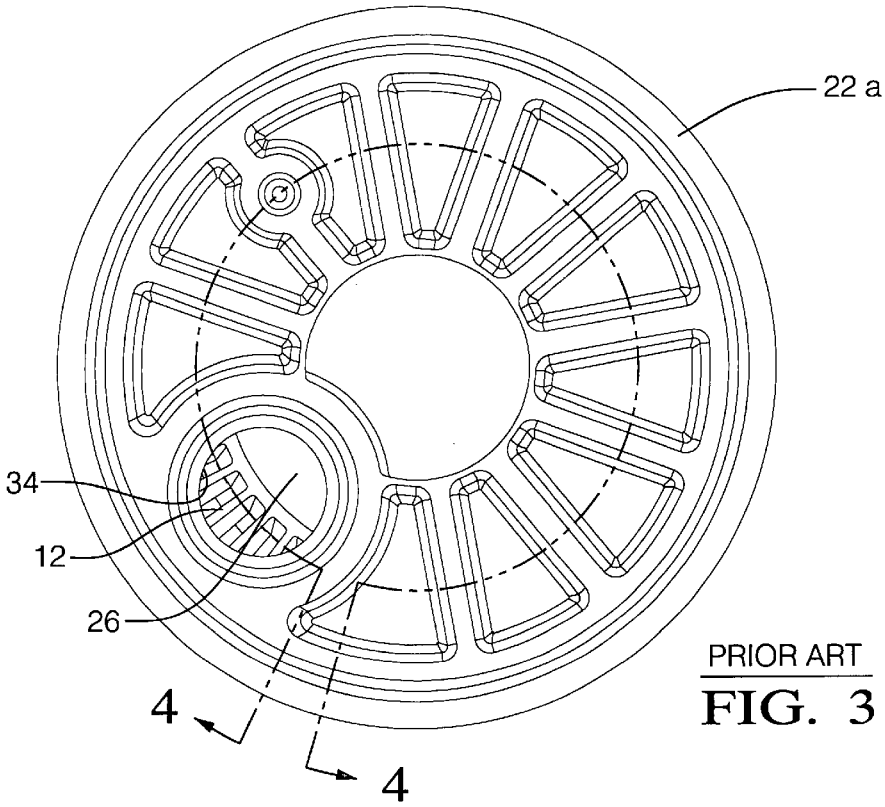
PRIOR ART FIG. 3
FIG. 3 is a sectional view taken generally along the plane indicated by lines A—A in FIG. 2, showing the vanes of the impeller through an inlet port defined in an outlet plate.
Figure 4:
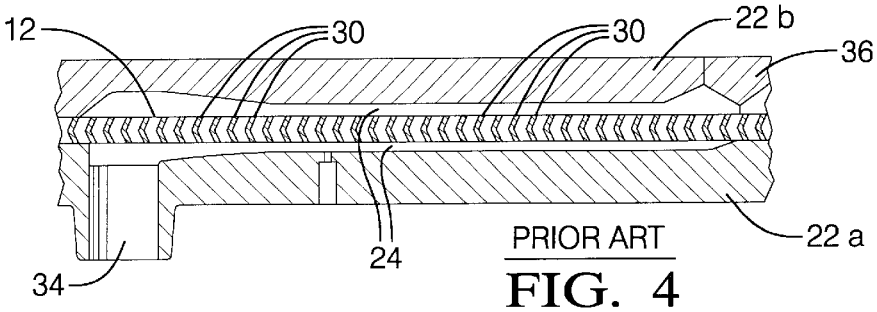
PRIOR ART FIG. 4
FIG. 4 is an enlarged sectional view taken generally along the perimeter indicated by lines B—B in FIG. 3, showing the relationship between the vanes of a prior art impeller and the inlet and outlet ports defined within the outer and inner plates, respectively, of the fuel pump.
Figure 5:
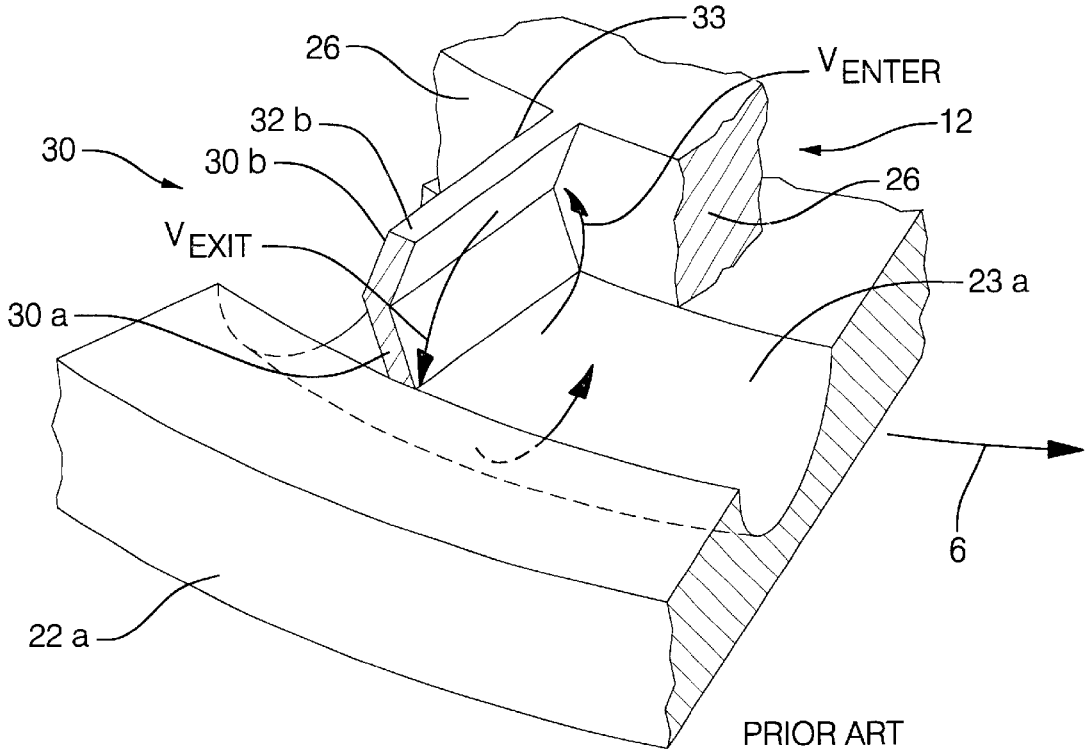
PRIOR ART FIG. 5
FIG. 5 is a partial three-dimensional view of the outer plate and the prior art impeller, showing how the vanes are oriented with respect to the annular pump channel.
Figure 6:
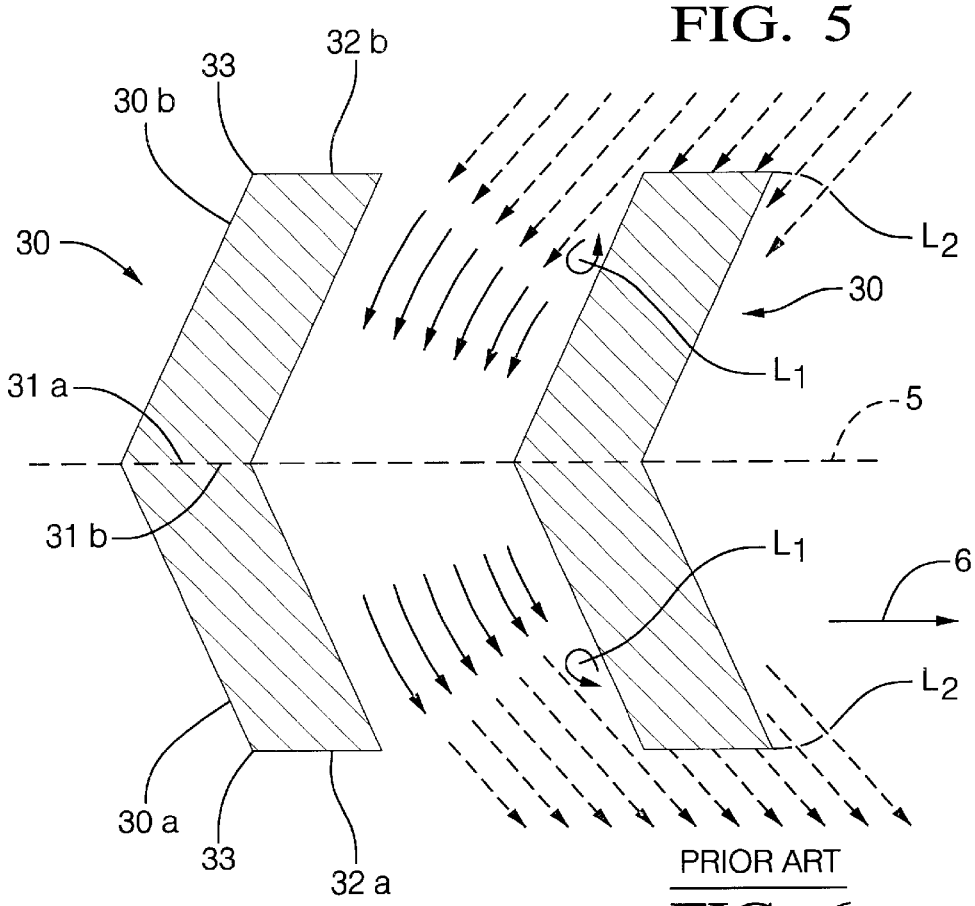
PRIOR ART FIG. 6
FIG. 6 is an enlarged top view of two adjacent vanes of the prior art impeller, showing how the fuel stream flows into and then around the fin members of, the leading vane.

The first and second annular grooves 23*a* and 23*b* cooperate to form an annular pump channel 23 at a periphery of a disk-shaped space 24 defined between the inner and outer plates 22*b* and 22*a*, as best shown in FIGS. 3 and 4. Outer plate 22*a* further defines an inlet port 34 that communicates with the first annular groove 23*a*. Similarly, inner plate 22*b* defines an outlet port 36 that communicates with second annular groove 23*b*.

In its preferred embodiment, the impeller 112 comprises a hub 26 and a plurality of innovative V-shaped vanes 130, as shown in FIGS. 7–13. As best shown in FIGS. 7, 8, 10 and 11, the hub 26 and vanes 130 can be formed on a single part by use of an injection molding process. Many injection molding processes are well known in the industry. The molding process used to make the prior art impeller 12 is one such known process, but it has heretofore not been used to make an impeller 112 having the novel features disclosed in this document.

Figure 7:
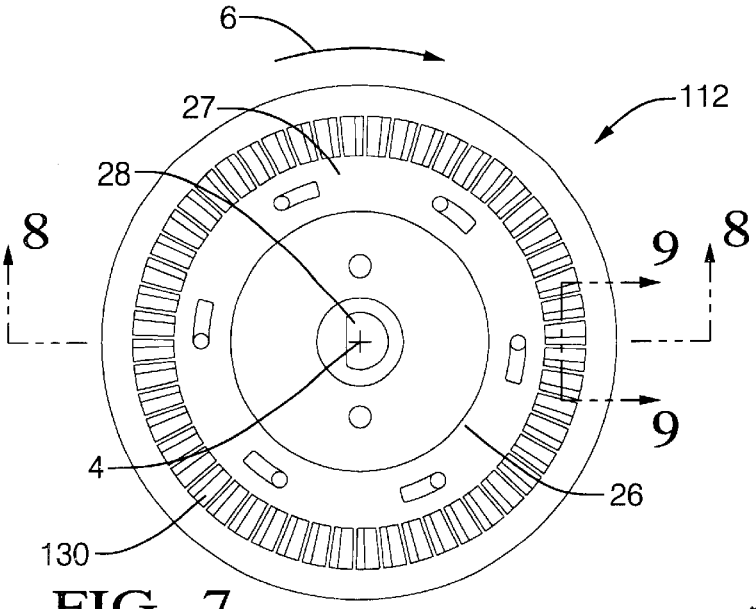
FIG. 7 is a side view of an impeller according to the invention, showing the axis on which it designed to rotate.
Figure 8:
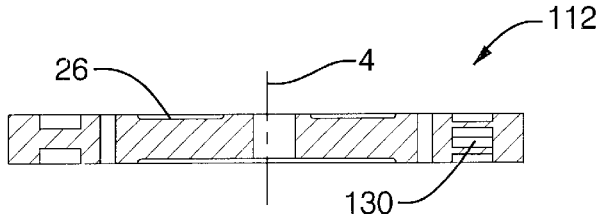
FIG. 8 is a sectional view taken generally along the plane indicated by lines A—A in FIG. 7.
Figure 10:
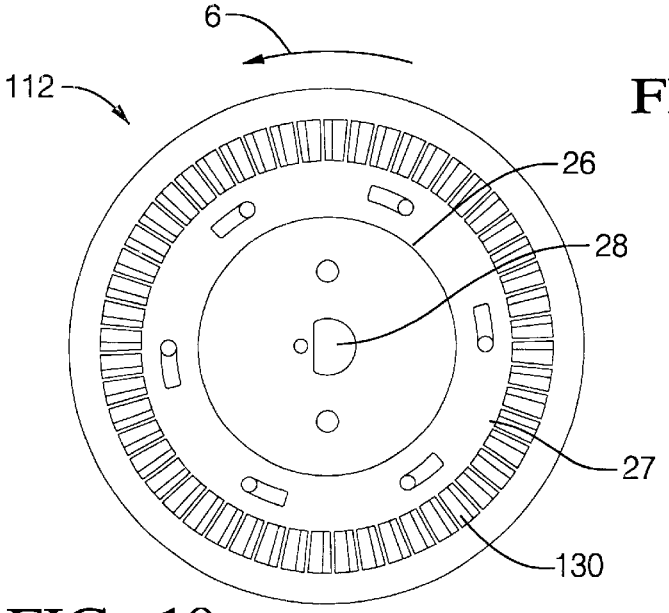
FIG. 10 is a side view of the impeller according to the invention, showing the side opposite of that shown in FIG. 7.

Referring to FIGS. 7, 10 and 11, the hub 26 has a cylindrical outer surface 27. The hub 26 also defines an aperture 28 into which the shaft 20 can be secured. This allows the impeller 112 to rotate with the shaft 20 about the center axis 4 in the forward direction 6, when the motor 18 is supplied with electricity via the terminal 11 that protrudes from the pump housing 14. During the injection molding process, the V-shaped vanes 130 are formed on the hub 26 so that they project radially outward from its cylindrical outer surface 27.

Secured to the shaft 20, the impeller 112 is designed to lie within the disk-shaped space 24, with the V-shaped vanes 130 lying between the first and second annular grooves 23*a* and 23*b* in the annular pump channel 23. Rotation of the impeller 112 moves the V-shaped vanes 130 along the annular pump channel 23 in the forward direction 6, shown in FIGS. 7, 9, 10, 12 and 13. The movement of the vanes 130 causes fuel from the fuel tank to be sucked into the inlet port 34 and flow into the annular groove 23*a*, and thus into the annular pump channel 23 and eventually out of the outlet port 36 in inner plate 22*b*.

As can be understood in the context of this invention in light of the information provided in background, the movement of the innovative vanes 130 imparts momentum to the fuel stream. The vanes 130 cause the fuel to whirl about the annular pump channel 23 in a toroidal flow path. This, of course, is characteristic of the regenerative cycle in which the fuel exits each vane 130 at the tip and then re-enters the base of the trailing vane 130. The regenerative cycle of exiting the tip of the leading blade 130 and entering the base of the trailing blade 130 occurs many times as the fuel is conveyed through the annular pump channel 23 by the moving vanes 130.

Figure 9:
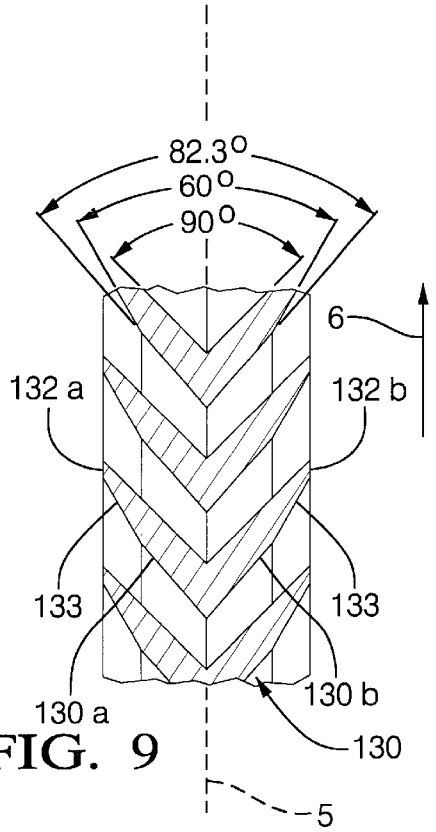
FIG. 9 is an enlarged, partial sectional view taken generally along the plane indicated by lines B—B in FIG. 7, showing a preferred configuration for the vanes of the impeller.

As best shown in FIGS. 9, 12 and 13, the V-shaped vanes 130 of the impeller 112 are distinct and uniquely configured, as compared to the vanes 30 of the prior art impeller 12. Each vane 130 comprises a pair of fin members 130*a* and 130*b*. Each fin member 130*a* and 130*b* has an inner sidewall 31*a* and 31*b*, respectively, and an outer sidewall 132*a* and 132*b*, respectively. When the impeller 112 is appropriately positioned with the disk-shaped space 24 between the inner and outer plates 22*a* and 22*b*, the first outer sidewall 132*a* of each vane 130 will lie adjacent to the first annular groove 23*a*. The second outer sidewall 132*b* will likewise lie adjacent to the second annular groove 23*b*.

The fin members of each V-shaped vane 130 are adjoined by their inner sidewalls. For example, as best shown in FIG. 12, fin members 130*a* and 130*b* of fan blade 130 are formed together during the molding process at their respective inner sidewalls 31*a* and 31*b*. From their adjoined inner sidewalls 31*a* and 31*b*, the fin members of each vane diverge to their respective outer sidewalls. For example, the fin members 130*a* and 130*b* diverge from the boundary at which their inner sidewalls 31*a* and 31*b* intersect to their respective outer sidewalls 132*a* and 132*b*. This is best shown in FIGS. 9, 12 and 13.

More specifically, the fin members 130*a* and 130*b* of each fan blade 130 diverge at a prespecified angle. This is also best shown in FIGS. 9, 12 and 13. Together, the fin members 130*a* and 130*b* of each V-shaped vane 130 thus present an upstream face and a downstream face. With respect to the upstream face of each V-shaped vane 130, the prespecified angle at which the fin members 130*a* and 130*b* diverge from each other lies within a range of between 25° and 65°. This angle is measured relative to a plane 5 that lies normal to the center axis 4 and bisects the hub 26. Preferably, this prespecified angle is 45°. As measured relative to each other, however, the fin members 130*a* and 130*b* preferably diverge at an angle of 90° on the upstream face of each vane 130, as is shown in FIG. 9.

With respect to the downstream face of each vane 130, the prespecified angle at which fin members 130*a* and 130*b* diverge from each other lies within a range of between 40° and 43° relative to the plane 5. Preferably, this prespecified angle is 41.15°. As measured relative to each other, however, the fin members 130*a* and 130*b* preferably diverge at an angle of 82.3° on the downstream face of each vane 130, as is shown in FIG. 9.

The novelty of the invention resides principally in the trailing corners 133 of each outer sidewall 132*a* and 132*b*. During the manufacturing process, each outer sidewall of each V-shaped vane 130 is chamfered at a predetermined angle along its trailing corner 133, as shown in FIGS. 9, 12 and 13. This predetermined angle lies within a range of 15° to 45° relative to the plane 5, as shown in FIGS. 12 and 13. Preferably, this predetermined angle is 30°. As measured relative to each other, however, the trailing corners 133 of each V-shaped vane 130 are chamfered at an angle of 60°, as is best shown in FIG. 9.

The predetermined angle would ideally be equal to the angle at which the fuel stream approaches each of the outer sidewalls, as the vanes 130 move along the annular pump channel 23. The preferred angle of 60° for the chamfer of the trailing corners 133 has been chosen to match, as closely as possible, the angle at which the fuel enters the base of the outer sidewall 132*a* and 132*b* of each vane 130. The chamfering of each trailing corner 133 gives each outer sidewall a narrower profile. This minimizes the separation of the fluid fuel stream that occurs behind each vane 130. Consequently, low pressure is less likely to develop behind each fin member 130*a* and 130*b*. This factor alone means that the stream of fuel loses less energy during each regenerative cycle, as compared to the prior art vanes 30.

Due to the chamfered trailing corners 133, the narrower profile of each outer sidewall 132*a* and 132*b* also reduces the surface area against which the fuel stream impacts. This factor also means less energy lost during the regenerative cycle, as compared to the prior art vanes 30. The innovative chamfer thus yields not only less separation and turbulence of the fuel stream behind each fin member 130*a* and 130*b* but also a reduction in the force with which the fuel stream impacts the leading corners of each vane 130. As compared to the prior art impeller 12, the impeller 112 with its uniquely configured vanes 130 causes the fuel stream to lose significantly less energy during operation of the regenerative turbine fuel pump 10.

In its preferred embodiment, the bevel or chamfer may ideally extend radially along the entire length of each fin member 130*a* and 130*b*. In an alternative preferred embodiment, the chamfer may traverse only the entrance half of each fin member 130*a* and 130*b*. As described earlier, as impeller 112 rotates, the fuel exits each vane 130 at the tip and then re-enters the base of the trailing vane 130 during each regenerative cycle. If it is necessary to further reduce the cost of manufacturing the impeller 112, the entire length of the trailing corner 133 of each outer sidewall 132*a* and 132*b* need not be beveled or chamfered. Merely chamfering each trailing corner 133 only along its lower section, closest to the base of the vane 130, will still yield suitably improved results. This lower section along the edge of each fin member is where the fuel stream enters each V-shaped vane 130 during the regenerative cycle, as the impeller 112 rotates.

The novel impeller 112 improves substantially upon the prior art impeller 12 discussed in background. It improves the overall mechanical efficiency of the high pressure section of the regenerative turbine pump 10. In doing so, however, the impeller 112 still retains a geometry that allows it to be manufactured by conventional injection molding techniques at a relatively low cost. More specifically, the geometry of the chamfer on the trailing corners 133 of each V-shaped vane 130 is achieved without adversely affecting either the thickness of the root of each vane or the helical angle of retraction characteristic of the injection molding process used to make the impeller 112. In other words, the impeller 112 is provided with streamlined vanes 130 in such a way as to not compromise or complicate the injection molding process used to make it.

Testing and analysis has revealed that a regenerative turbine fuel pump equipped with the impeller (112) provides 25% higher head capability not only when the pump (10) is shutoff but also throughout the range of flow with no increase in torque. Moreover, the performance of a regenerative turbine pump (10) equipped with the impeller (112) is greatly improved versus impellers having standard straight or V-shaped vanes.

The presently preferred embodiments for carrying out the invention have been set forth in detail according to the Patent Act. Persons of ordinary skill in the art to which this invention pertains may nevertheless recognize various alternative ways of practicing the invention without departing from the spirit and scope of the following claims. Persons who possess such skill will also recognize that the foregoing description is merely illustrative and not intended to limit any of the ensuing claims to any particular narrow interpretation.

Accordingly, to promote the progress of science and the useful arts, we secure for ourselves by Letters Patent exclusive rights to all subject matter embraced by the following claims for the time prescribed by the Patent Act.

We claim:

1. An impeller for a regenerative turbine fuel pump, said regenerative turbine fuel pump having an electric motor; a shaft rotatable by said electric motor about a center axis in a forward direction; a generally cylindrical outer plate having an inside face that defines a first annular groove; and a generally cylindrical inner plate having an outside face that defines a second annular groove; said first and said second annular grooves cooperating to form an annular pump channel at a periphery of a disk-shaped space defined between said inner and said outer plates; said outer plate also defining an inlet port that communicates with said first annular groove, said inner plate also defining an outlet port that communicates with said second annular groove; said impeller comprising:

a hub defining an aperture into which said shaft is securable to allow said hub to rotate with said shaft about said center axis, said hub having a cylindrical outer surface; and a plurality of V-shaped vanes projecting radially outward front said cylindrical outer surface of said hub, said impeller disposed within said disk-shaped space with said V-shaped vanes lying between said first and said second annular grooves for movement along said annular pump channel in said forward direction by rotation of said impeller to impart momentum to a fuel stream flowing in said inlet port through said annular pump channel and out said outlet port;

each of said V-shaped vanes comprising a pair of fin members with each said fin member having an inner sidewall, said fin members of each said pair being adjoined by said inner sidewalls thereof so that said fin members of each said pair present an upstream face facing said forward direction and a downstream face facing a rearward direction, said upstream face diverging at a first prespecified angle relative to a plane that bisects said hub normal to said center axis, said downstream face diverging at a second prespecified angle relative to said plane, said first prespecified angle being larger than said second prespecified angle, an intersection or said pair of fin members extending radially outward from said cylindrical outer surface of said hub, each said pair of fin members further having a first outer sidewall adjacent to said first annular groove and a second outer sidewall adjacent to said second annular groove, each said outer sidewall having a trailing corner disposed at an intersection of each said outer sidewall and each said downstream face of said fin member, each said outer sidewall of each said fin member being provided with a chamfer at a predetermined angle relative to said plane bisecting said hub normal to said center axis along said trailing corner of said outer sidewall; and each of said chamfers provided on each of said trailing corners of said fin members being disposed substantially between and substantially adjacent to said first and second annular grooves forming said pump chamber.

2. The impeller claimed in claim 1 wherein said predetermined angle is substantially equal to an angle at which said fuel stream approaches each of said outer sidewalls of said pair of fin members when said impeller is being rotated.

3. The impeller claimed in claim 1 wherein said predetermined angle lies within a range of 15° to 45° relative to said plane.

4. The impeller claimed in claim 3 wherein said predetermined angle is 30° relative to said plane.

5. The impeller claimed in claim 1 wherein said first prespecified angle lies within a range of between 25° and 65° relative to said plane for said upstream face of said V-shaped vane.

6. The impeller claimed in claim 5 wherein said first prespecified angle is 45° relative to said plane for said upstream face of said V-shaped vane.

7. The impeller claimed in claim 1 wherein said second prespecified angle lies within a range of between 40° and 43° relative to said plane for said downstream face of said V-shaped vane.

8. The impeller claimed in claim 7 wherein said second prespecified angle is 41.15° relative to said plane for said downstream face of said V-shaped vane.

9. The impeller claimed in claim 1 wherein said aperture defined in said hub is notched to permit said impeller to be securely fitted onto said shaft of like shape.

10. An impeller for a regenerative turbine pump, said impeller comprising:

a hub having a cylindrical outer surface and defining an aperture into which a shaft of said turbine pump is securable to allow said hub to rotate about a center axis therewith; and a plurality of V-shaped vanes projecting radially outward from said cylindrical outer surface of said hub, each of said V-shaped vanes comprising a pair of fin members with each said fin member having an inner sidewall and an outer sidewall, said fin members of each said pair being adjoined by said inner sidewalls thereof and diverging therefrom at a prespecified angle relative to a plane that bisects said hub normal to said center axis so that said fin members of each said pair present an upstream face and a downstream face, an intersection of said pair of fin members extending radially outward from said cylindrical outer surface of said hub, each said outer sidewall having a trailing corner disposed at an intersection of each said outer sidewall and each said downstream face of said fin member, and each of said outer sidewalls of each of said V-shaped vanes being provided with a chamfer disposed at a predetermined angle relative to said plane bisecting said hub normal to said center axis along a lower length of said trailing corner of said outer sidewall;

each of said chamfers provided on each of said trailing corners of said fin members being disposed substantially between and substantially adjacent to first and second annular grooves forming a pump chamber of said turbine pump, said chamfers being configured to reduce, as compared to a chamferless outer sidewall, an impact of said outer sidewall with said fuel stream in said pump chamber which mitigates separation of said fuel stream at said downstream face and reduces low pressure in said fuel stream at said downstream face.

11. The impeller claimed in claim 10 wherein each said outer sidewall of said V-shaped vanes is chamfered at said predetermined angle relative to said plane along an entire length of said trailing corner of said outer sidewall.

12. The impeller claimed in claim 10 wherein said predetermined angle relative to said plane is substantially equal to an angle at which a fuel stream within said turbine pump approaches said outer sidewalls of said V-shaped vanes as said impeller is being rotated by said shaft.

13. The impeller claimed in claim 10 wherein said predetermined angle lies within a range of 15° to 45° relative to said plane.

14. The impeller claimed in claim 13 wherein said predetermined angle is 30° relative to said plane.

15. The impeller claimed in claim 10 wherein said prespecified angle at which said fin members of each said pair diverge lies within a range of between 25° and 65° relative to said plane for said upstream face of said V-shaped vane.

16. The impeller claimed in claim 15 wherein said prespecified angle at which said fin members of each said pair diverge is 45° relative to said plane for said upstream face of said V-shaped vane.

17. The impeller claimed in claim 10 wherein said prespecified angle at which said fin members of each said pair diverge lies within a range of between 40° and 43° relative to said plane for said downstream face of said V-shaped vane.

18. The impeller claimed in claim 17 wherein said prespecified angle at which said fin members of each said pair diverge is 41.15° relative to said plane for said downstream face of said V-shaped vane.

19. The impeller claimed in claim 10 wherein said aperture defined in said hub is notched to permit said impeller to be securely fitted onto said shaft of like shape.

20. An impeller for a regenerative turbine pump, comprising:

a hub rotatable about a center axis by said regenerative turbine pump;

a plurality of vanes projecting from said hub radially outward to a tip remote from said hub, each of said vanes being disposable within a pump chamber of said regenerative turbine pump such that upon rotation of said impeller by said regenerative turbine pump a single toroidal flow path is formed in a fuel stream in said pump chamber by each of said vanes, said toroidal flow path exiting each of said plurality of vanes at said tip and re-entering at said hub of a trailing vane;

each of said plurality of vanes comprising a first fin member and a second fin member, said first and second fin members defining an upstream face, a downstream face, an upper outer sidewall, and a lower outer sidewall, said first and second fin members diverging at a first prespecified angle at said upstream face and at a second prespecified angle at said downstream face, said first and second prespecified angle being measured relative to a plane that lies normal to said center axis and bisects said hub;

a first trailing corner being defined by an intersection of said downstream face and said upper outer sidewall; and a first chamfer being disposed at a portion of said first trailing corner in a predetermined anglo relative to said plane.

21. The impeller as in claim 20, wherein said first prespecified angle is about 45° and said second prespecified angle is about 41.15°.

22. The impeller as in claim 20, wherein said predetermined angle relative is substantially equal to an angle at which said fuel stream approaches said upper outer sidewall of each of said plurality of vanes.

23. The impeller as in claim 22, wherein said predetermined angle is about 30°.

24. The impeller as in claim 20, wherein said first chamfer is defined along an entire length of said first trailing corner.

25. The impeller as in claim 20, wherein said first chamfer is defined at said hub along about half of a length of said first trailing corner.

26. The impeller as in claim 20, wherein said first chamfer provides a narrow profile to said upper outer sidewall such that upon rotation of said impeller by said regenerative turbine pump an impact of said upper outer sidewall with said fuel stream in said pump chamber is reduced as compared to a chamferless outer sidewall.

27. The impeller as in claim 20, wherein said first chamfer reduces separation of said fuel stream at said downstream face to reduce low pressure in said fuel stream at said downstream face as compared to a chamferless outer sidewall.

28. The impeller as in claim 20, further comprising:

a second trailing corner being defined by an intersection of said downstream face and said lower outer sidewall;

a second chamfer being disposed at a portion of said second trailing corner in said predetermined angle relative to said plane, said second chamfer being configured to provide a narrow profile to said lower outer sidewall such that upon rotation of said impeller by said regenerative turbine pump an impact of said lower outer sidewall with said fuel stream in said pump chamber is reduced as compared to a chamferless outer sidewall.

29. The impeller as in claim 28, wherein said second chamfer reduces, as compared to a chamferless outer sidewall, separation of said fuel stream at said downstream face to reduce low pressure in said fuel stream at said downstream face.

30. The impeller as in claim 28, wherein said second chamfer is either defined along an entire length of said second trailing corner, or at said hub along about half of a length of said second trailing corner.

* * * * *